US005988083A

United States Patent [19]

Tomita et al.

[11] Patent Number: 5,988,083

[45] Date of Patent: Nov. 23, 1999

[54] SEWING APPARATUS

[75] Inventors: Shintaro Tomita, Nagoya; Nami Morita, Aichi-ken, both of Japan

[73] Assignee: Brother Kogyo Kabushiki Kaisha, Nagoya, Japan

[21] Appl. No.: 09/220,606

[22] Filed: Dec. 28, 1998

[30] Foreign Application Priority Data

Feb. 9, 1998 [JP] Japan ..... 10-044536

[51] Int. Cl.[6] ..... D05B 19/00; D05B 21/00; D05C 5/02

[52] U.S. Cl. ..... 112/102.5; 112/475.19

[58] Field of Search ..... 112/102.5, 470.06, 112/475.19, 456, 457, 458; 364/470.09, 470.07

[56] References Cited

U.S. PATENT DOCUMENTS

| | | | |
|---|---|---|---|
| 4,849,902 | 7/1989 | Yokoe et al. | 112/102.5 X |
| 5,359,949 | 11/1994 | Asano | 112/102.5 |
| 5,390,126 | 2/1995 | Kongho et al. | 112/102.5 X |

FOREIGN PATENT DOCUMENTS

| | | |
|---|---|---|
| B2-1-40635 | 8/1989 | Japan . |
| A-6-154442 | 6/1994 | Japan . |
| A-6-154443 | 6/1994 | Japan . |
| A-8-89678 | 4/1996 | Japan . |
| A-8-98968 | 4/1996 | Japan . |
| B2-2561650 | 9/1996 | Japan . |

*Primary Examiner*—Peter Nerbun
*Attorney, Agent, or Firm*—Oliff & Berridge, PLC

[57] ABSTRACT

When a power source of an electronic control type embroidery machine is switched on, all pattern data of a plurality of embroidery patterns stored on a ROM card is summarily written to either a pattern data memory of RAM (volatile memory) or a flash memory (involatile memory) without any instruction for storing the data. As a result, the ROM card can be detached during the embroidery sewing operation, embroidery sewing of the plurality of embroidery patterns is simplified and operational performance of the sewing operation can be improved.

26 Claims, 11 Drawing Sheets

SEWING APPARATUS

BACKGROUND OF THE INVENTION

1. Field of the Invention

The present invention relates to a sewing apparatus, particularly to a sewing apparatus in which all of pattern data of a plurality of embroidery patterns stored to an external storage medium is summarizingly stored in an internal memory and a sewing apparatus in which pattern data of a group of patterns which are designated from pattern data of a plurality of embroidery patterns stored to an external storage medium is summarizingly stored to an internal memory.

2. Description of Related Art

Conventionally, according to an electronic control type embroidery machine for household use having an embroidery device, pattern data of a plurality of embroidery patterns is stored to a pattern data memory installed to ROM (involatile memory) of a control device or a ROM card which is an external storage medium. Patterns are displayed on a display, desired patterns are searched while switching a display screen and when a desired embroidery pattern is selected, embroidery sewing is carried out based on sewing data of the selected embroidery pattern.

For example, Japanese Patent Publication No. 2561650 proposed by the applicant describes a sewing machine in which sewing data of a plurality of embroidery patterns is stored in an internal memory installed in a control device in correspondence with code numbers. In addition, a memory cassette storing sewing data and configuration display data of a plurality of embroidery patterns is detachably mounted thereon. In selecting embroidery patterns of the memory cassette, a configuration of a desired embroidery pattern for sewing is displayed on a display by operating a pattern selecting key while sewing data of the selected embroidery pattern is read from the memory cassette and embroidered on cloth. Further, for reference, Japanese Examined Patent Publication No. JP-B-1-40635 proposes a switch pattern display device in which pattern display data is formed from sewing data.

As mentioned above, according to the sewing machine described in Japanese Patent Publication No. 2561650, at each time of selecting an embroidery pattern for sewing, sewing data of the selected embroidery pattern is read from a memory cassette to the control device of the sewing machine. This presents a problem in that when the memory cassette is erroneously detached from the sewing machine in carrying out embroidery sewing, pattern selection or embroidery sewing cannot be carried out and when a plurality of embroidery patterns to be sewn are dispersingly stored in a plurality of memory cassettes, at each time of sewing, the memory cassettes are interchanged and operational performance of embroidery operation is deteriorated, or the like.

SUMMARY OF THE INVENTION

It is an object of the present invention to be able to detach an external pattern data memory during embroidery sewing operation and to be able to sew a plurality of embroidery patterns stored to the external pattern data memory to thereby promote operational performance of sewing operation.

According to a first aspect of the present invention, there is provided a sewing apparatus comprising an internal pattern data memory for storing pattern data of a plurality of embroidery patterns, an external pattern data receiving device supplied with data from an external storage medium storing pattern data of a plurality of embroidery patterns other than the plurality of embroidery patterns stored to the internal pattern data memory, displaying unit including a display and capable of displaying patterns, sewing mechanism for sewing the embroidery patterns based on the pattern data, and a first data writing device for reading all of the data stored to the external storage medium and writing the data to an internal memory different from the internal pattern data memory when a power source is switched on.

According to the present invention, in receiving data supplied from an external storage medium of a ROM card, a floppy disk or the like, by the external pattern data receiving device, when the power source is switched on at the sewing apparatus, the first data writing device summarizingly reads all of the pattern data of the plurality of embroidery patterns stored to the external storage medium and writes it to the internal memory. Further, sewing operation is performed by the sewing mechanism based on the embroidery pattern designated from the plurality of embroidery patterns stored to the internal memory.

According to the present invention, the first data writing device is provided and therefore, all of the pattern data of the plurality of embroidery patterns stored to the external storage medium can summarizingly be written to the internal memory only by switching on the power source without carrying out storage operation for storing data to the internal memory. Also, the external storage medium can be detached during embroidery sewing operation, embroidery sewing of the plurality of embroidery patterns is simplified and the operational performance of sewing operation can be improved.

Further, according to another aspect of the present invention, there is provided a sewing apparatus comprising an internal pattern data memory for storing pattern data of a plurality of embroidery patterns, an external pattern data receiving device supplied with data from an external storage medium storing pattern data of a plurality of embroidery patterns other than the plurality of embroidery patterns stored to the internal pattern data memory, displaying unit including a display and capable of displaying patterns, sewing mechanism for sewing the embroidery patterns based on the pattern data, and a second writing device for reading pattern data of a designated pattern group from the pattern data of the plurality of pattern groups stored to the external storage medium and writing the data to an internal memory different from the internal pattern data memory.

According to the present invention, in receiving data supplied from an external storage medium such as a ROM card, a floppy disk or the like, by the external pattern data receiving device, the second writing device reads summarizingly the pattern data of the designated pattern group of, for example, "animal", "flower" or the like, from the pattern data of the plurality of pattern groups stored to the external storage medium and writes the data to the internal memory. Further, sewing operation is carried out by a sewing mechanism based on the pattern data of the designated embroidery pattern from the plurality of the embroidery patterns stored to the internal memory.

According to the present invention, the second writing device is provided and accordingly, the pattern data of a desired pattern group of "animal", "flower" or the like, can summarizingly be written from the pattern data of the plurality of the pattern groups stored to the external storage medium, to the internal memory, the external storage medium can be detached during embroidery sewing operation, embroidery sewing of the plurality of embroidery patterns is simplified and the operational performance of sewing operation can be improved.

Further, the sewing apparatus of the present invention is featured in having an identifying and displaying controller for displaying group display marks indicating the pattern groups stored to the internal memory such that the display marks can be identified from group display marks indicating the pattern groups stored to the internal pattern data memory. In this case, the group displaying marks indicating the pattern groups of the plurality of embroidery patterns stored to the internal memory are displayed identifiably by reverse display or the like in contrast to the group display marks indicating the pattern groups stored to the internal pattern data memory by the identifying and displaying controller.

According to the present invention, there is provided the identifying and displaying controller for identifiably displaying the group display marks indicating the pattern groups stored to the internal memory in contrast to the group display marks indicating the pattern groups stored to the internal pattern data memory and accordingly, kinds of the pattern groups stored to the internal memory can simply be recognized via the display device.

Further, the sewing apparatus of the present invention is featured in that the internal memory comprises a writable volatile memory. In this case, the internal memory for storing the pattern data of the plurality of embroidery patterns of the external pattern data memory comprises a volatile memory of a writable RAM or the like. According to the present invention, the internal memory comprises the writable volatile memory and accordingly, pattern data can be erased simultaneously with turning off the power source and the internal memory can be inexpensive.

Further, the sewing apparatus of the present invention is featured in that the internal memory comprises a writable involatile memory. In this case, the internal memory for storing the pattern data of the plurality of embroidery patterns of the external pattern data storing means comprises an involatile memory of a writable flash memory (electrically erasable and writable memory) or the like. According to the present invention, the internal memory comprises the writable involatile memory and accordingly, even when the power source is turned off, stored pattern data can firmly be stored.

Further, according to the sewing apparatus of the present invention, the internal memory is provided with a writable volatile memory and an involatile memory and a writing selector is provided for selecting to which of the volatile memory and the involatile memory data is to be written. In this case, the internal memory is provided with the writable volatile memory and the involatile memory and accordingly, whether the pattern data of the plurality of embroidery patterns of the external storage medium is written to the volatile memory or the involatile memory can be selected by the writing selector. According to the present invention, the internal memory is provided with the writable volatile memory and the involatile memory and the writing selector is provided for selecting to write data to either of the volatile memory and the involatile memory. Accordingly, pattern data which may be erased in turning off the power source is stored to the volatile memory and in the meantime, pattern data intended to be stored even when the power source is turned off may be stored to the involatile memory.

Further, the sewing apparatus of the present invention is featured in having a pattern selector for selecting an embroidery pattern for sewing from the plurality of embroidery patterns stored to the internal memory. In this case, a desired embroidery pattern for sewing can be selected from the plurality of embroidery patterns stored to the internal memory by the pattern selector. According to the present invention, there is provided the pattern selector for selecting the embroidery pattern for sewing from the plurality of embroidery patterns stored to the internal memory and accordingly, a desired embroidery pattern for sewing can simply be selected from the plurality of embroidery patterns stored to the internal memory.

Further, according to another aspect of the present invention, there is provided a sewing apparatus comprising an external pattern data receiver supplied with data from an external storage medium storing pattern data of embroidery patterns, a sewing mechanism for sewing the embroidery patterns based on the pattern data, and a third data writing device for reading the data stored to the external storage medium and writing the data to an internal memory when a power source is switched on.

According to the present invention, in receiving data supplied from the external storage medium which is a ROM card, a floppy disk or the like, by the external pattern data receiver, when the power source is switched on at the sewing apparatus, the third data writing device summarizingly reads the pattern data of the embroidery patterns stored to the external storage medium and writes the data to the internal memory different from internal pattern data memory. Further, a sewing operation is carried out by the sewing mechanism based on the pattern data of the embroidery pattern designated from the plurality of embroidery patterns stored to the internal memory.

According to the present invention, the third data writing device is provided and accordingly, the pattern data of the embroidery patterns stored to the external storage medium can be written to the internal memory by only switching on the power source without carrying out storing operation for storing the data to the internal memory. Therefore, the external storage medium can be detached in the embroidery sewing operation and the operational performance of sewing operation can be improved.

BRIEF DESCRIPTION OF THE DRAWINGS

An embodiment of the present invention will be described in detail with reference to the following figures in which like reference numerals refer to like elements, and wherein.

DETAILED DESCRIPTION OF PREFERRED EMBODIMENTS

An explanation will be given of embodiments according to the present invention in reference to the drawings as follows.

Figure 1:
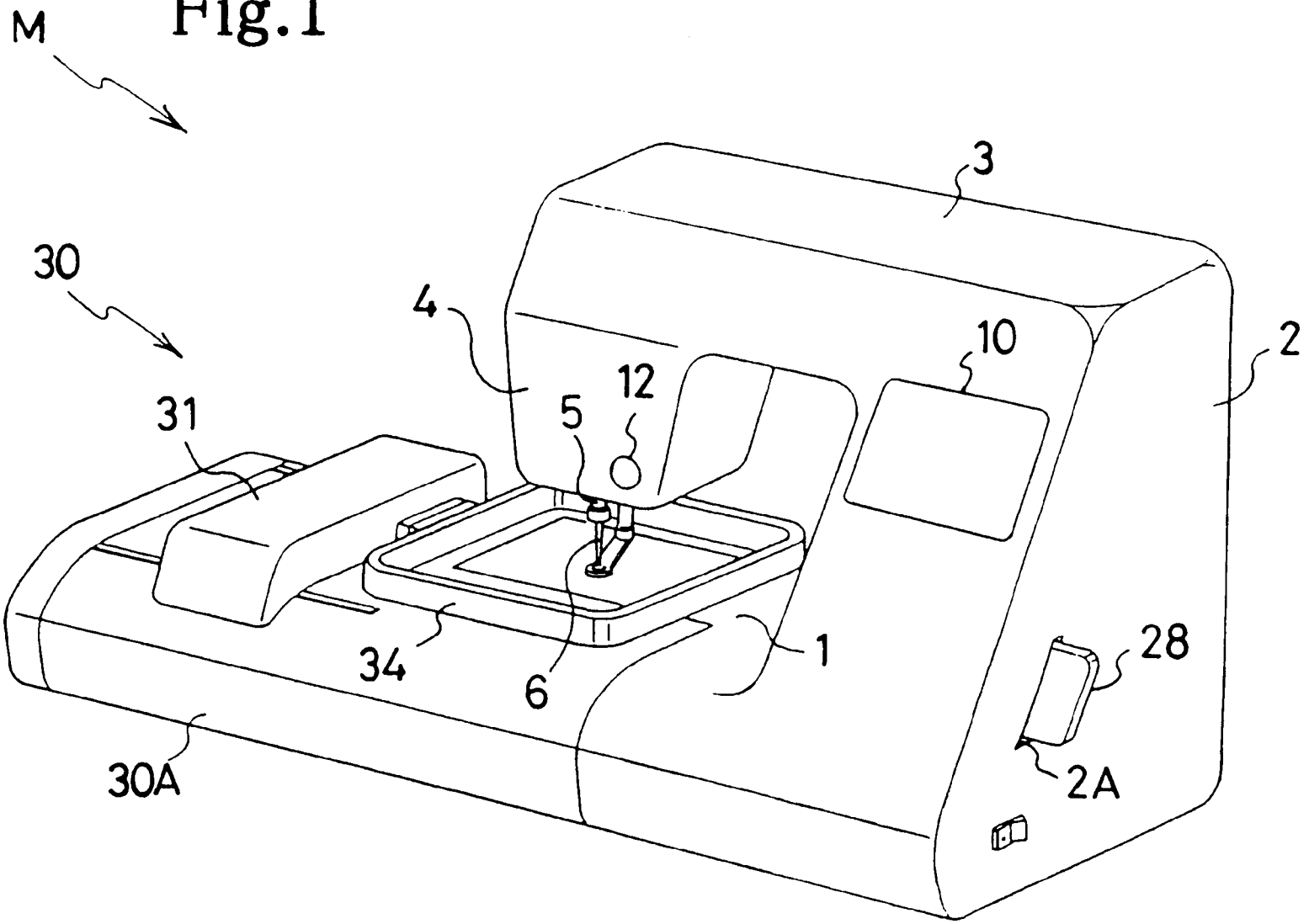
FIG. 1 is a perspective view of an electronic control type embroidery machine according to an embodiment of the present invention.

An embodiment is shown in FIG. 1 as an example in which the present invention is applied to an electronic control type embroidery machine having an embroidery device capable of sewing various embroidery patterns by detachably mounting the embroidery device and a ROM card. Although this embodiment is shown using a ROM card, any external data source could be used such as, for example, a CD ROM, a floppy disk or a data link to a stand alone computer or processor.

An electronic control type embroidery machine M is provided with a machine bed portion 1, a pedestal portion 2 erected from a right end portion of the bed portion 1 and an arm portion 3 extending from an upper end of the pedestal portion 2 to the left to be opposed to the bed portion 1.

The bed portion 1 is installed with a feed dog vertical moving mechanism (not illustrated) for moving a feed dog in the up and down direction and a feed dog horizontal moving mechanism (not illustrated) for moving the feed dog in the forward and rearward direction, a thread ring catcher (for example, horizontally rotating shuttle) containing a lower thread bobbin and moving in cooperation with a sewing needle 6. The pedestal portion 2 is formed with a slot 2A for connecting a ROM card 28 (corresponding to external storage medium) recorded with pattern data (pattern display data, sewing data and appended information) for an optionally added number of embroidery patterns to a card connector 13 (refer to FIG. 2) inside of the machine.

The arm portion 3 is installed with a needle rod driving mechanism for moving a needle rod 5 mounted with the sewing needle 6 at its lower end in the up and down direction, a needle rod rocking mechanism (not illustrated) for rocking the needle rod 5 in a direction orthogonal to a cloth feed direction, a needle thread take-up driving mechanism (not illustrated) for moving a needle thread take-up in the up and down direction in conformity with movement of the needle rod 5 in the up and down direction and so on. Further, the feed dog vertical moving mechanism, the needle rod driving mechanism and the needle thread take-up driving mechanism are driven by a machine motor 17, the needle rod rocking mechanism is driven by a stepping motor 18 for rocking the needle rod and the feed dog horizontal moving mechanism is driven by a stepping motor 19 for driving the feed dog (refer to FIG. 2). A head portion 4 of the arm portion 3 is installed with a start/stop switch 12 for instructing starting and stopping of the sewing operation.

A large-sized liquid crystal display 10 is provided on a front face of the arm portion 3 and the liquid crystal display 10 is displayed with various seam patterns of practically-used patterns, embroidery patterns and the like, names of various functions, various messages and so on. The front face of the liquid crystal display 10 is installed with, for example, touch keys 11 comprising transparent electrodes in a matrix corresponding to display positions of a plurality of embroidery patterns and function names showing functions. That is, selection of a desired embroidery pattern and function can be realized by pressing the touch keys 11 in correspondence with the embroidery pattern and the function name. Although a touch key display is used as an example, other display types can be used.

A left end side portion of the bed portion 1 is formed with a free bed portion referred to as a free arm and an embroidery device 30 is detachably mounted to the free bed portion.

The embroidery device 30 is provided with a main body case 30A, an embroidery frame 34 for detachably mounting cloth for fabrication, a containing case containing a Y-direction driving mechanism for driving the embroidery frame 34 in the Y-direction (forward and rearward direction) and an X-direction driving mechanism contained in the main body case 30A which is an X-direction driving mechanism for driving the containing case and the Y-direction driving mechanism inside thereof in the X-direction (left and right direction). The X-direction driving mechanism is driven by a first stepping motor 32 and the Y-direction driving mechanism is driven by a second stepping motor 33 (refer to FIG. 2).

When the embroidery device 30 is mounted to the free bed portion, the first and second stepping motors 32 and 33 are electrically connected to a control device C of the embroidery machine M via a connector 14, the state of mounting the embroidery device 30 is detected and in the meantime, the first and second stepping motors 32 and 33 are controlled by the control device C and the embroidery frame 34 and cloth for fabrication are brought into the state where embroidery sewing can be carried out while driving to move them in the X-direction and the Y-direction independently from each other.

Next, an explanation will be given of the control system of the embroidery machine M.

Figure 2:
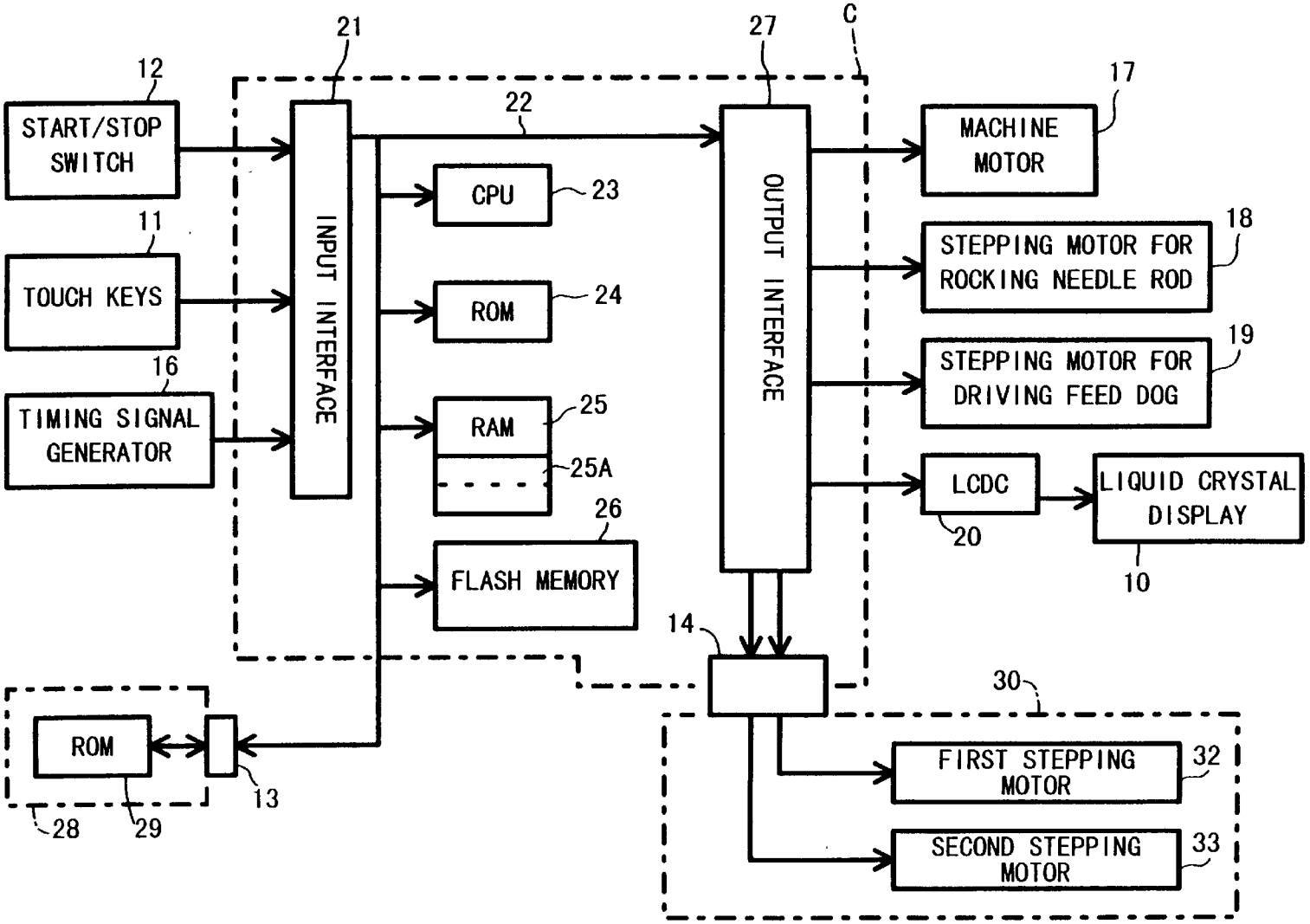
FIG. 2 is a block diagram of a control system of an electronic control type embroidery machine.

As shown by FIG. 2, the control device C is provided with an input interface 21, a computer including CPU 23, ROM 24, RAM (Random Access Memory) 25 and an electrically erasable and writable flash memory 26, an output interface 27 and a bus 22 connecting these. The input interface 21 is respectively connected with the start/stop switch 12, the touch keys 11 and a timing signal generator 16 for detecting a plurality of rotational phases of a machine main spindle.

The output interface 27 is connected to the machine motor 17, the stepping motor 18 for rocking the needle rod, the stepping motor 19 for driving the feed dog, a display controller (LCDC) 20 for the liquid crystal display 10, the connector 14 to which the first and the second stepping motors 32 and 33 are respectively connected and so on. ROM 29 of the ROM card 28 is connected to the bus 22 via the connector 13.

A control program memory of ROM 24 is previously stored with a control program of pattern selecting control for selecting practically-used patterns or various embroidery patterns, a sewing control program for sewing a selected embroidery pattern, a general control program of display control, a control program of editing processing for carrying out editing processing of setting a size, changing a sewing position and the like via the display 10, a control program of card data writing control which will be mentioned later as a feature of the application, and so on. Further, a pattern data memory (which corresponds to internal pattern data memory) is stored with pattern data having display data and sewing data corresponding to pluralities of practically-used patterns and letter patterns concerning practically-used letters (Japanese syllabary, alphabet and or on) which are classified into groups of kinds of patterns and associated with pattern numbers.

In the meantime, a plurality of sheets of the ROM cards 28 are prepared in accordance with kinds of embroidery patterns and ROM 29 of the ROM card 28 is recorded with pattern data of a number of embroidery patterns (first embroidery pattern, second embroidery pattern, third embroidery pattern . . . ) for each of a group of patterns of various diagrams or configurations, marks, characters (for example, famous person, animal, robot and the like appearing in TV programs, movies, etc) and so on in addition to a general group of patterns of "animal", "vehicle", "flower" and the like having comparatively high frequencies of use.

Figure 3:
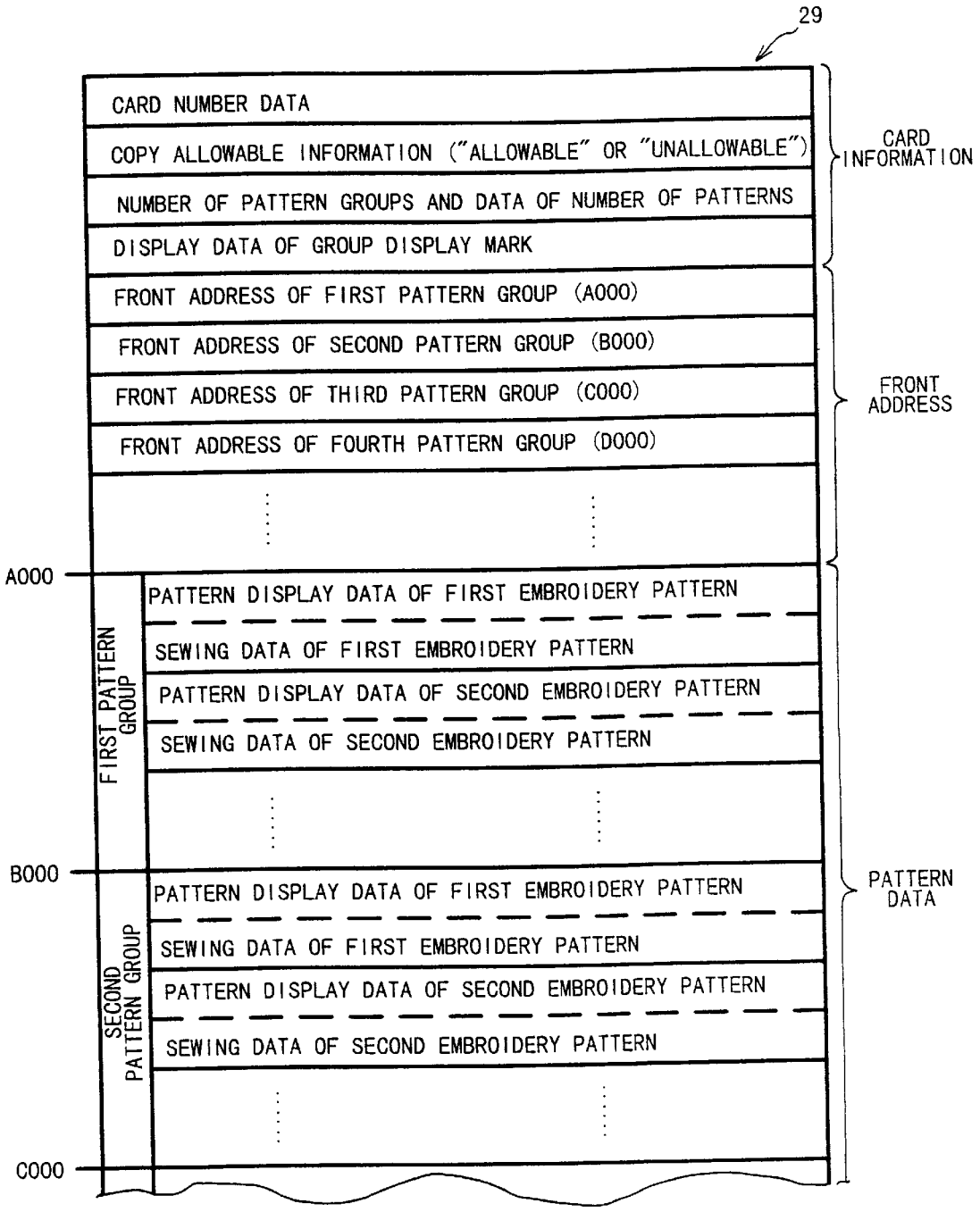
FIG. 3 is a diagram for explaining data structure of a ROM card.

That is, as shown by FIG. 3, ROM 29 is stored with card information including data of "card number", data of "copy allowable information" indicating whether data can be copied, data of "number of pattern groups" and "number of patterns" included in respective pattern groups, display data of group display marks indicating respective pattern groups and so on, front addresses of the plurality of pattern groups (first pattern group, second pattern group, third pattern group . . . ), pattern data storing pairs of pattern display data and sewing data of pluralities of embroidery patterns (first embroidery pattern, second embroidery pattern, third embroidery pattern . . . ) included in the respective pattern groups and appended display data for appending the display information, although not illustrated, with a classification. In this case, "copy allowable information" of the ROM card 28 including a copyrighted character is set to "nonallowable".

In this case, although not illustrated, when embroidery patterns are constituted by a plurality of colors (white, red, black, . . . ), pattern display data is provided with display data of color-classified pattern units in accordance with numbers of colors and sewing data is provided with sewing data for the respective color-classified pattern units and stop codes for switching color. In this case, the pattern display data is stored in a style of bit map data (dot image data).

RAM 25, which is the volatile memory, is provided with memories (memory of flag, pointer, counter and the like, register, buffer, etc) necessary for various controls mentioned above in addition to the pattern data memory 25A storing pattern data of a plurality of embroidery patterns stored in ROM 29 of the ROM card 28 by copying it. Further, the flash memory 26 which is an involatile memory is stored with pattern data of a plurality of embroidery patterns stored in ROM 29 by copying it in a similar manner to the pattern data memory 25A. The pattern data memory 25A is provided with a memory capacity capable of storing pattern data of a plurality of sheets of the ROM cards 28.

Figure 4:
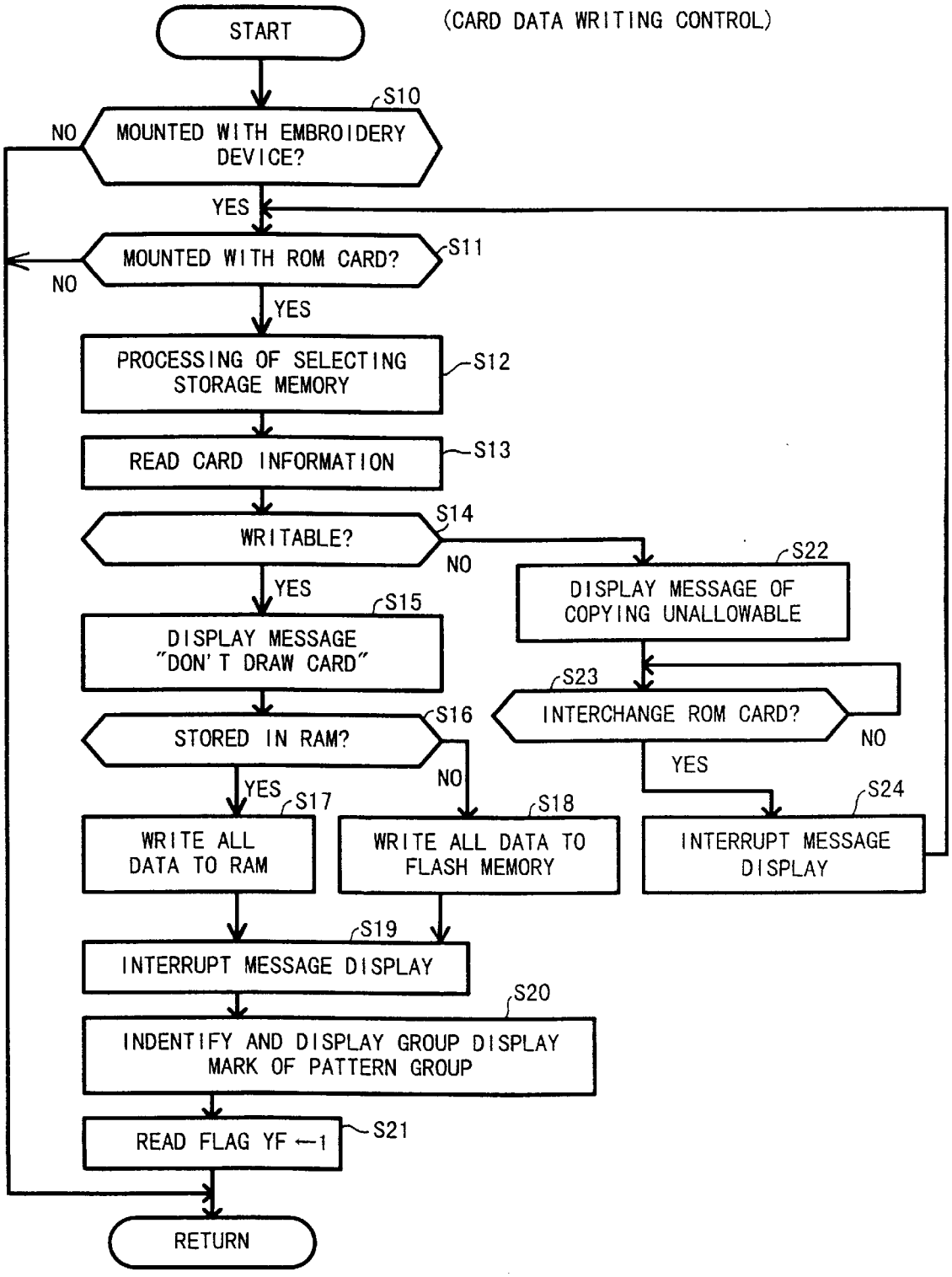
FIG. 4 is a flowchart of a routine of card data writing control.

Next, an explanation will be given of a routine of card data writing control (which corresponds to the input device) executed by the control device C in reference to the flowchart of FIG. 4. Further, notations Si (i=10, 11, 12 . . . ) in the drawing indicate respective steps.

When the control is started by switching on the power source, first, mounting of the embroidery device 30 is detected via connection of the two stepping motors 32 and 33 in respect of the connector 14 (S10: Yes).

Figure 5:
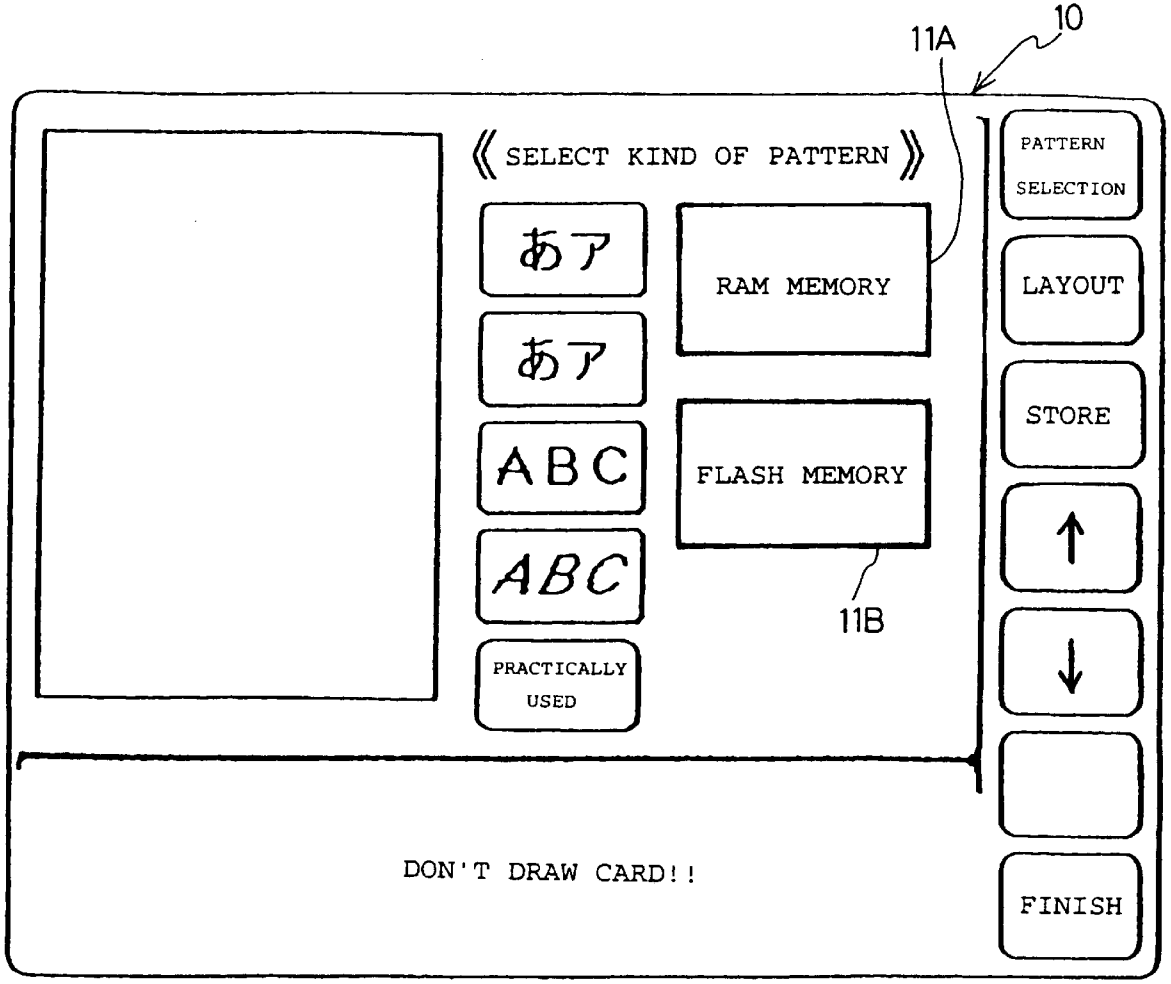
FIG. 5 is an explanatory view of an initial screen for selecting patterns.

Further, when mounting of the ROM card 28 is detected (S11: Yes), a storage memory selecting processing for selecting whether data stored to ROM 29 of the mounted ROM card 28 is to be copied and stored to the pattern data memory 25A of RAM 25 or to be copied and stored to the flash memory 26, is executed (S12). For example, as shown by FIG. 5, the display 10 is displayed with a selection key 11A for selecting "RAM memory" and a selection key 11B for selecting "flash memory" at an initial screen for selecting practically-used patterns or embroidery patterns and accordingly, a memory for storing data is selected by pressing a desired selection key.

Next, card information stored at a front portion of ROM 29 is read (S13). Further, when copy allowable information included in the card information is "allowable" and writable (S14: Yes), a message "Don't draw card!!" is displayed on the display 10 (S15). For example, as shown by FIG. 5, the message is displayed on the lower side of the display screen. Next, when data is stored to RAM as storage memory selected by step S12 (S16: Yes), all of data (card information, front address, pattern data of respective pattern groups) is summarizingly read and written to the pattern data memory 25A (S17).

In the meantime, when the data is stored to the flash memory 26 (S16: No), similar to step S17, all data stored to ROM 29 is summarizingly read and stored to the flash memory 26 (S18).

Figure 6:
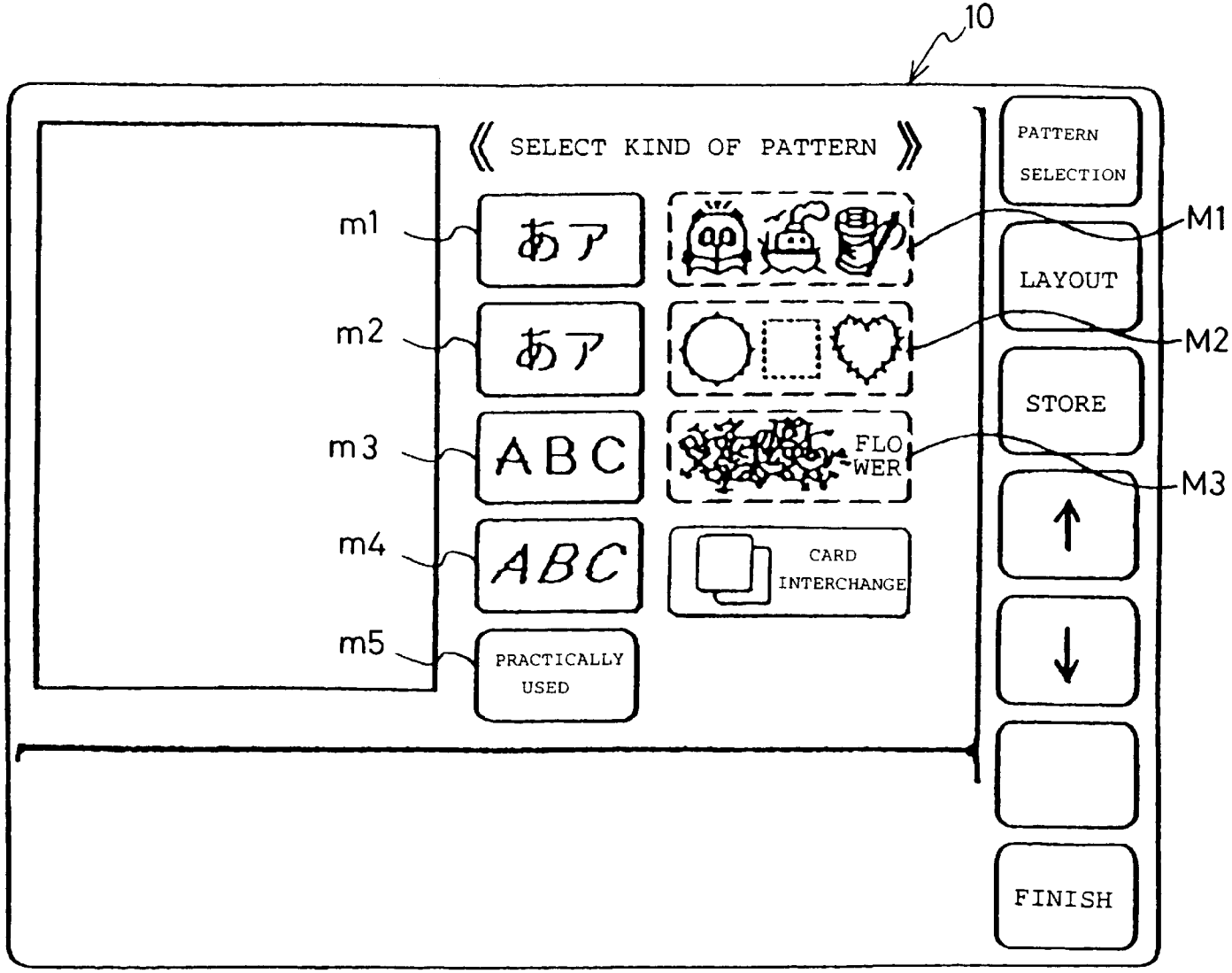
FIG. 6 is an explanatory view of a display screen displaying a group of a plurality of patterns.

Next, display of the message instructed at step S15 is interrupted (S19), display data of group display marks included in the card information is read and group display marks of all of pattern groups included in the ROM card 28 are identified and displayed on the display 10 (S20). For example, as shown by FIG. 6, group display marks M1 through M3 of an initial three pattern groups among a plurality of pattern groups included in the ROM card 28 are identified and displayed on the display 10 by broken line frames.

That is, although group display marks ml through m5 of a plurality of practically-used pattern groups stored to ROM 24 are respectively displayed by bold line frames, the group display marks M1 through M3 of the pattern groups included in the ROM card 28 are identified and displayed by the broken line frames. Next, a read flag YF exclusive for the ROM card 28 read this time is set (flag data is set to "1") (S21), the control is finished and the operation returns to a main routine.

Figure 7:
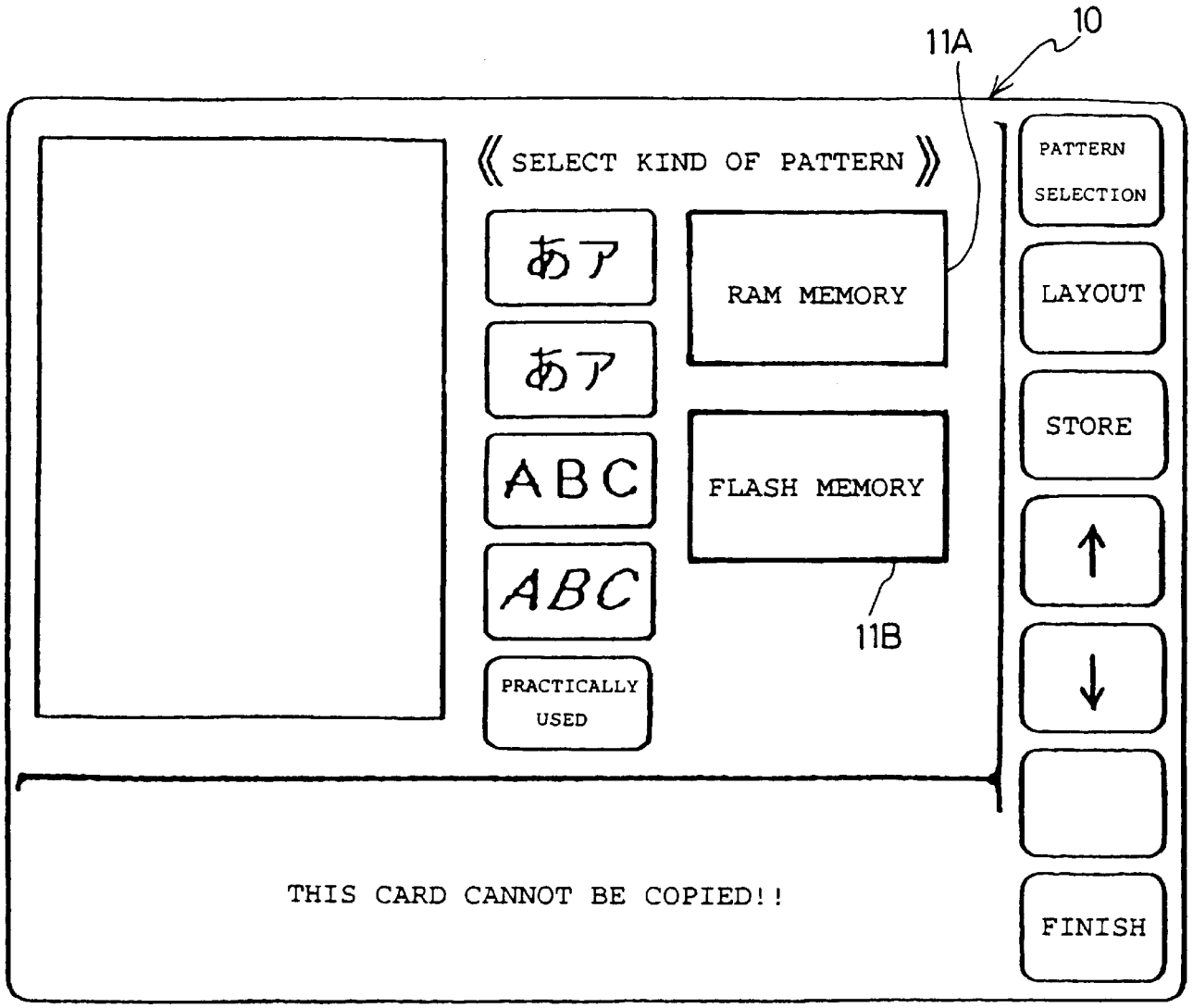
FIG. 7 is a view in correspondence with FIG. 5 including an error message.

Meanwhile, when copying is prohibited by copyright, the copy allowable information is "unallowable" and writing operation cannot be executed (S14: No), a message stating that copying is unallowable is displayed on the display 10 (S22). For example, as shown by FIG. 7, a message of "This card cannot be copied!!" is displayed on the lower side of the display screen. Further, when the ROM card 28 is interchanged by other copiable card (S23: Yes), the message instructed at step S22 is interrupted (S24) and the operation proceeds to S11.

In the meantime, when mounting of the embroidery device 30 cannot be detected (S10: No) or mounting of the ROM card 28 is not detected (S11), the control is immediately finished and the operation returns to start.

Further, although not illustrated, by executing pattern selecting control (which corresponds to pattern selector), first, desired pattern groups are selected via the group display marks M1 through M3 from a plurality of pattern groups stored to the pattern data memory 25A or the flash memory 26. Further, an embroidery pattern for sewing operation is individually selected from the pattern groups and embroidery sewing is carried out by the sewing apparatus 30 based on sewing data of the selected embroidery pattern.

As has been explained above, when the power source is switched on at the electronic control type embroidery machine M, in the case where the ROM card 28 is mounted to the embroidery machine M, all of the pattern data of a plurality of embroidery patterns stored to the ROM card 28 can be summarizingly written to either of the pattern data memory 25A or the flash memory 26 with no instruction for storing the data in an internal memory. The ROM card 28 can be detached during the embroidery sewing operation, the embroidery sewing operation of a plurality of embroidery patterns can be simplified and operational performance of sewing operation can be improved.

Figure 8:
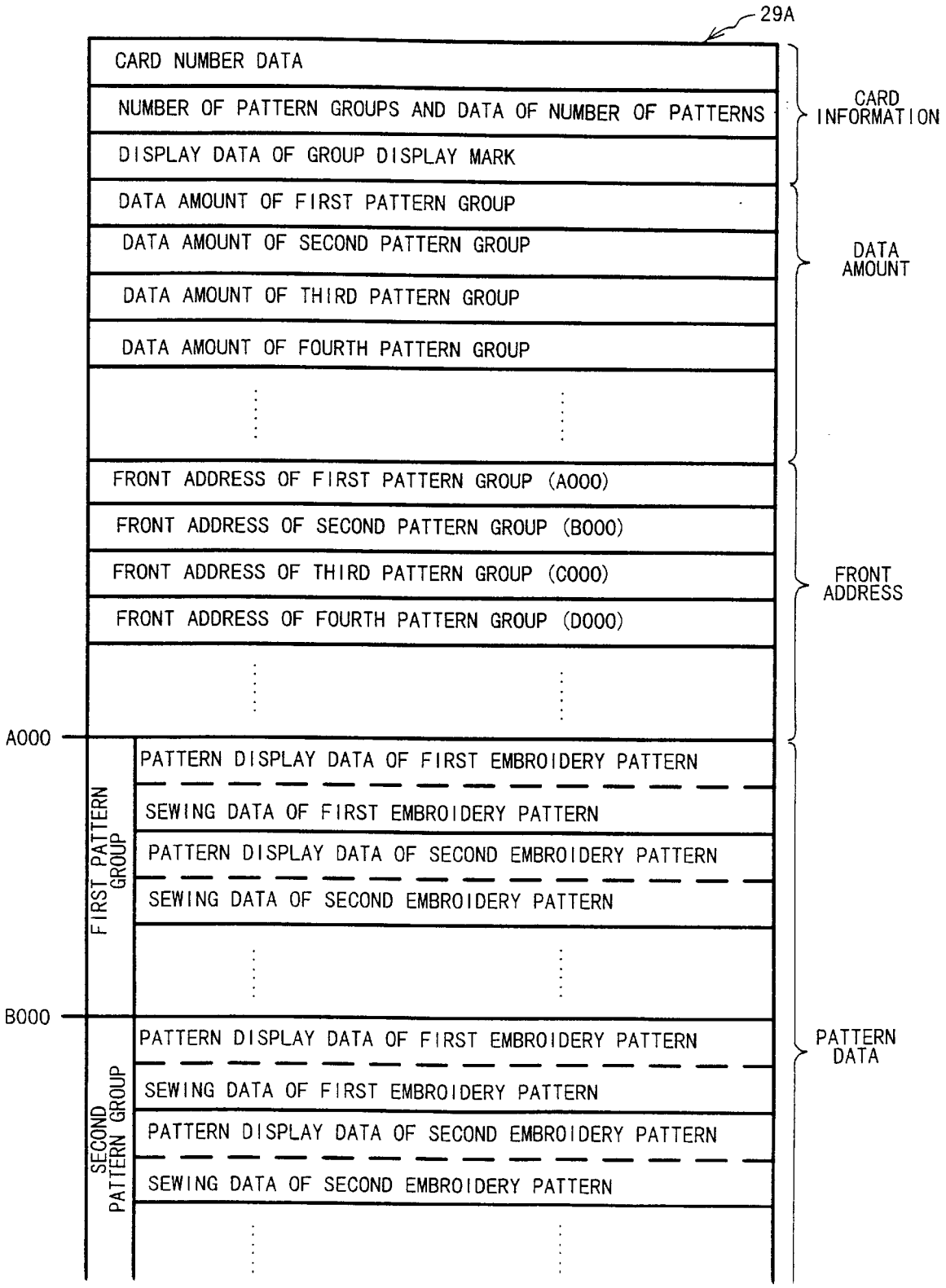
FIG. 8 is a view in correspondence with FIG. 3 according to a modified embodiment.

In the meantime, as shown by FIG. 8, ROM 29A of the ROM card 28 may be stored with card information including data of "card number", data of "number of pattern groups" and "number of patterns" included in each pattern group, display data of group display marks indicating respective pattern groups and so on, data amounts of a plurality of pattern groups (first pattern group, second pattern group, third pattern group . . . ), front addresses of the plurality of pattern groups, pattern data storing pairs of pattern display data of pluralities of embroidery patterns (first embroidery pattern, second embroidery pattern, third embroidery pattern . . . ) included in the respective pattern groups and sewing data and so on by a classification. As a result, pattern data of designated pattern groups may be summarizingly read.

Figure 9:
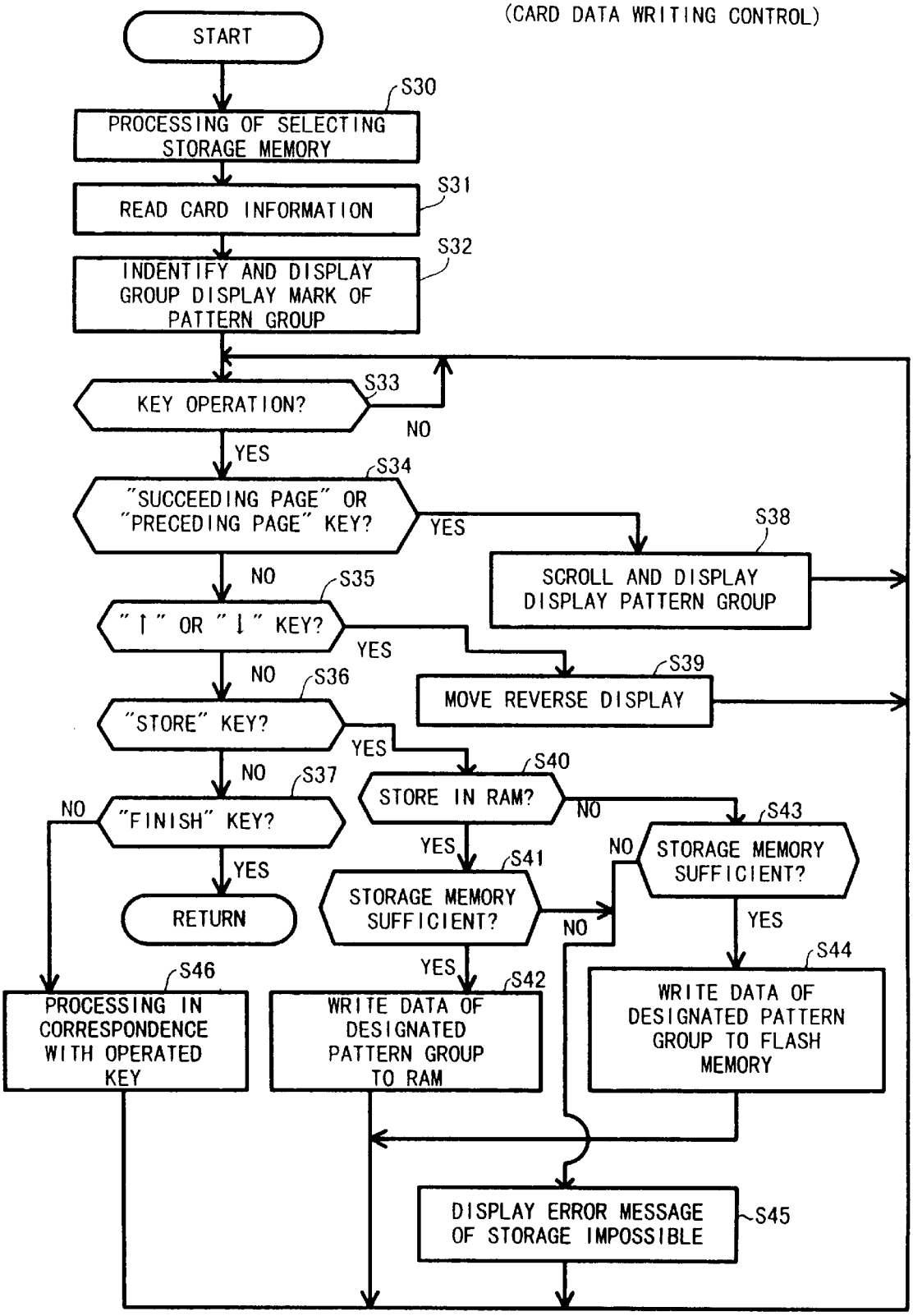
FIG. 9 is a diagram in correspondence with FIG. 4 according to the modified embodiment of FIG. 8.

However, in starting to control, the ROM card 28 is mounted to the embroidery machine M. That is, when the power source is switched on, card data writing control (which corresponds to the input device) of FIG. 9 is executed.

Figure 10:
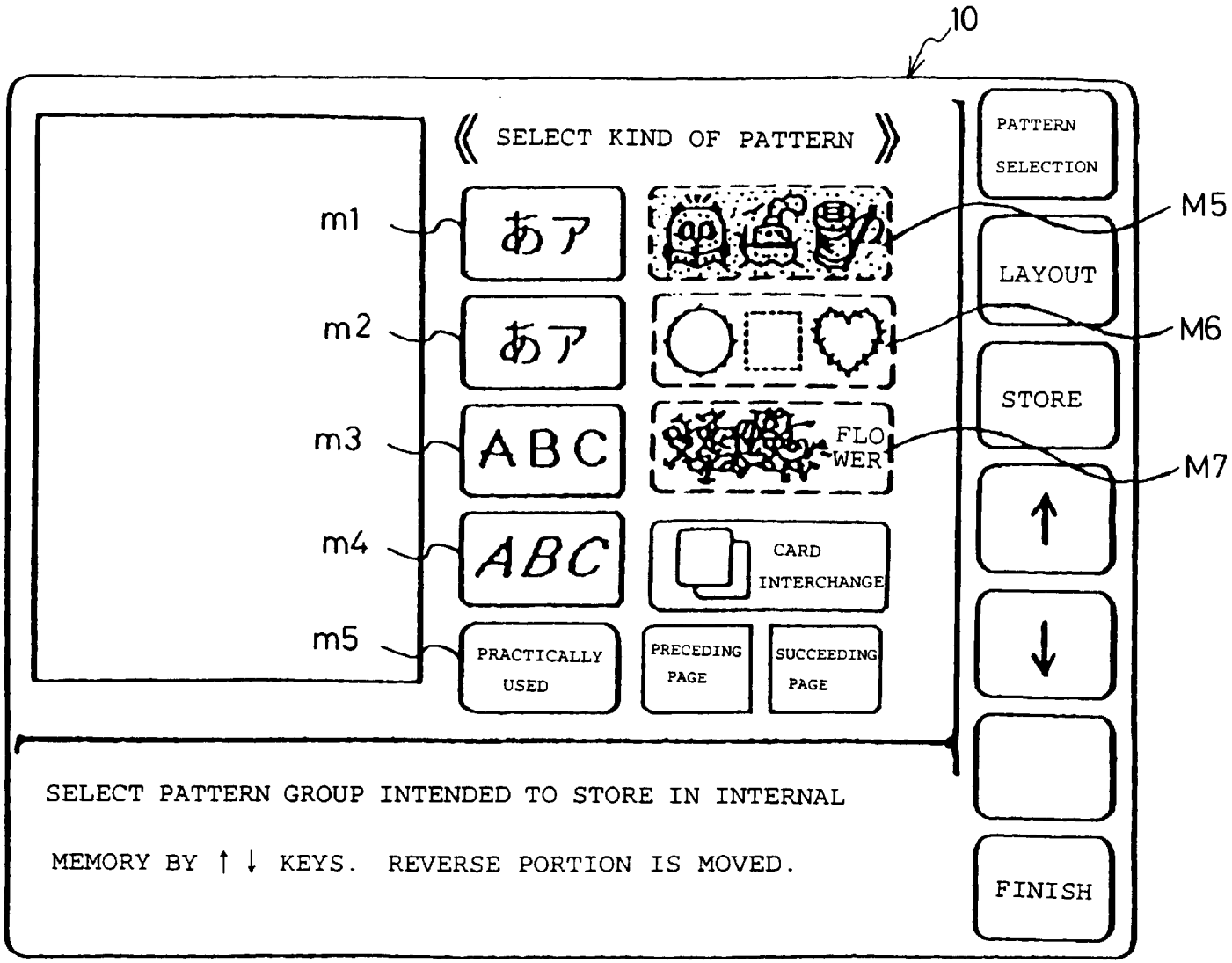
FIG. 10 is an explanatory view of a display screen displaying three group display marks.

When the control is started, first, similar to step S12, a storage memory selecting processing for storing pattern data is executed (S30), further, similar to step S13, card information is read (S31). Next, display data of the group display marks included in the card information is read and the group display marks of pattern groups are identified and displayed (S32). For example, as shown by FIG. 10, group display marks M5 through M7 of an initial three pattern groups among a plurality of pattern groups included in the ROM card 28 are identified and displayed respectively on the display 10 by broken line frames.

In this case, the front group display mark M5 is reversely displayed and pattern data of the front pattern group can be copied and stored. Further, by succeeding steps of S33 through S36, pattern groups to be stored are controlled to change. That is, a page indicating key of a "preceding page" key or a "succeeding page" key is operated (S33 S34: Yes), and scroll display for scrolling a plurality of displayed pattern groups in the display order in accordance with the operated page indicating key, is executed (S38). Meanwhile, when a moving key of "" key or a "" key is operated (S33: Yes, S34: No, S35: Yes), a reverse display movement for moving reverse display in a direction in accordance with the moving key is executed (S39).

Further, when a "store" key is operated (S33: Yes, S34 S35: No, S36: Yes), in the case where data is stored to RAM as storage memory selected by step S30 (S40: Yes), a data amount of a pattern group designated via the reverse display is calculated, a memory remaining amount of the pattern data memory 25A is calculated, when a memory capacity sufficient for writing data of the designated pattern group can be secured (S41: Yes), pattern data of the designated pattern group is summarizingly read from ROM 29A and written to the pattern data memory 25A (S42). In this case, the data amount of the designated pattern group may be calculated based on data amounts of pattern data of a plurality of embroidery patterns included in the pattern group.

Figure 11:
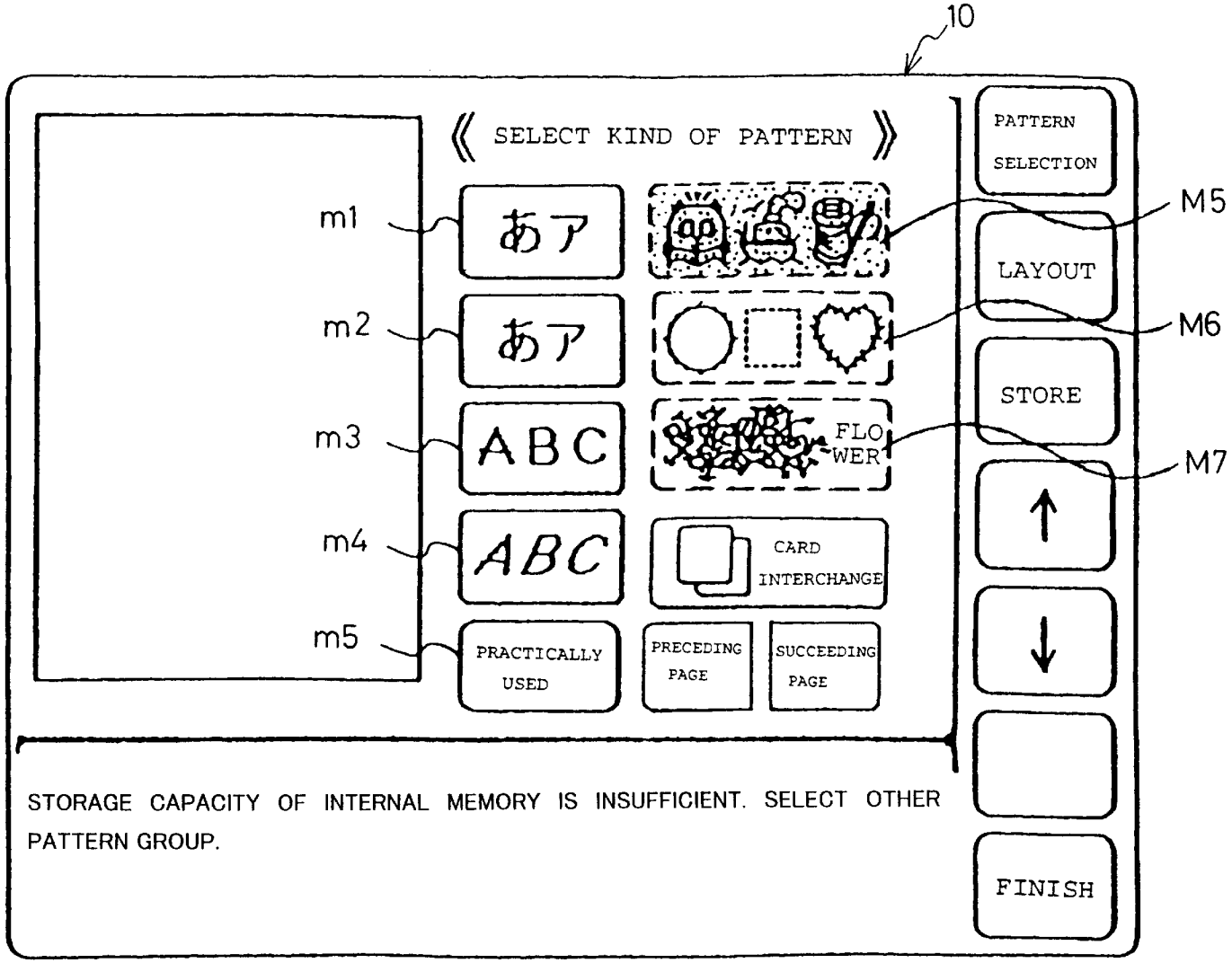
FIG. 11 is a view in correspondence with FIG. 10 including an error message.

In the meantime, when the memory capacity sufficient for writing data of the designated pattern group cannot be secured (S41: No), an error message of unstorable is displayed on the display 10 (S45) and the operation proceeds to S33. For example, as shown by FIG. 11, a message stating "Storage capacity of internal memory is insufficient . . . " is displayed. Hence, the operator designates to store another pattern group by operating the page indicating key or the moving key by reverse display.

In the meantime, in storing data to the flash memory 26 (S40: No), similar to step S41, when a memory capacity sufficient for writing data of the designated pattern group can be secured (S43: Yes), pattern data of the designated pattern group is summarizingly read and is written to the flash memory 26 (S44).

Further, when a key other than the page indicating key or the moving key or the storage key is operated (S37: No), a processing in correspondence with the operated key is executed (S46) and when a "finish" key is operated (S33: Yes, S34 through S36: No, S37: Yes), the control is finished and the operation returns to the main routine. Thereafter, by carrying out pattern selecting control, firstly, a desired pattern group is selected via the group display marks M5 through M7 from a plurality of pattern groups stored to the pattern data memory 25A or the flash memory 26, further, an embroidery pattern for sewing is individually selected from the pattern groups and embroidery sewing is carried out by the embroidery device 30 based on sewing data of the selected embroidery pattern.

As has been explained, by only designating a desired pattern group of "animal", "flower" or the like via the reverse display from a plurality of pattern groups stored to the ROM card 28 mounted to the electronic control type embroidery machine M, pattern data of the designated pattern group can be summarizingly written to either of the pattern data memory 25A or the flash memory 26, the ROM card 28 can be detached during the embroidery sewing operation and the embroidery sewing operation of a plurality of embroidery patterns is simplified and operational performance of sewing operation can be improved.

In this case, the pattern data memory 25A of RAM 25 and the flash memory 26 correspond to the internal memory. The external pattern data receiving device is constituted by the connector 13, the pattern data memory 25A and the flash memory 26, the card data writing control, the control device C and the like. The liquid crystal display 10, the display controller 20 and the like correspond to the displaying unit. Further, step S20 of the card data writing control shown by FIG. 4 or step S32 of the card data writing control shown by FIG. 9 or the like correspond to the identifying and displaying controller.

Next, an explanation will be given of modified embodiments of the above-described embodiment.

(1) In place of the flash memory 26, various involatile memories of a RAM card, a floppy disk or the like backed by a battery may be adopted.

(2) Only either the pattern data memory 25A or the flash memory 26 may be provided.

(3) Pattern data of a plurality of embroidery patterns stored to the ROM card 28 may be received via wireless communication of, for example, a telephone network, internet or the like.

(4) In the case of a simplified type embroidery machine where a pattern data memory is not provided in ROM 24 and a display device including the display 10 is not provided, when the power source is switched on, card data writing control may be carried out such that pattern data of a few (for example, one or two) embroidery patterns stored to the mounted ROM card 28 is read and written to RAM 25 and sewing operation may be carried out based on the pattern data by only starting the machine M. In this case, the card data writing control corresponds to the third writing device.

(5) The card data writing control according to the above-described embodiments shows only examples and can be carried out with various modification within a scope not deviated from the technical thought of the present invention.

While the invention has been described in conjunction with the specific embodiments described above, it is evident that many alternatives, modifications and variations will be apparent to those skilled in the art. Accordingly, the embodiments of the invention as set forth above are intended to be illustrative and not limiting. Various changes may be made without departing from the spirit and scope of the invention as defined herein.

What is claimed is:

1. A sewing apparatus, comprising:

a first internal memory for storing first pattern data of a plurality of embroidery patterns;

a second internal memory different from the first internal memory;

an external pattern data receiver supplied with data from an external storage medium storing second pattern data of a plurality of embroidery patterns other than the plurality of embroidery patterns stored to the first internal memory;

a displaying unit having a display and capable of displaying patterns;

a sewing mechanism for sewing the embroidery patterns based on one of the first pattern data and the second pattern data; and an input device that reads all of the second pattern data stored to the external storage medium and writes the second pattern data to the second internal memory when a power source is switched on.

2. The sewing apparatus according to claim 1, further comprising:

an identifying and displaying controller that displays group display marks indicating pattern groups stored to the second internal memory such that the display marks can be identified from displayed group display marks indicating pattern groups stored to the first internal memory.

3. The sewing apparatus according to claim 1, wherein the second internal memory comprises a writable volatile memory.

4. The sewing apparatus according to claim 1, wherein the second internal memory comprises a writable involatile memory.

5. The sewing apparatus according to claim 1, further comprising a writing selector, wherein the second internal memory comprises a writable volatile memory and a writable involatile memory and the writing selector selects to which of the volatile memory and the involatile memory the second pattern data is written.

6. The sewing apparatus according to claim 1, further comprising a pattern selector that selects an embroidery pattern for sewing from the plurality of embroidery patterns stored to the second internal memory.

7. A sewing apparatus, comprising:

a first internal memory for storing first pattern data of a plurality of embroidery patterns;

a second internal memory different from the first internal memory;

an external pattern data receiver supplied with data from an external storage medium storing second pattern data of a plurality of embroidery pattern groups other than the plurality of embroidery patterns stored to the first internal memory;

a displaying unit having a display and capable of displaying patterns;

a sewing mechanism for sewing the embroidery patterns based on one of the first pattern data and the second pattern data; and an input device that reads pattern data of a designated pattern group from the second pattern data of the plurality of embroidery pattern groups stored to the external storage medium and writes the pattern data of the designated pattern group to the second internal memory.

8. The sewing apparatus according to claim 7, wherein the input device reads the pattern data of the designated pattern group from the second pattern data of the plurality of embroidery pattern groups stored to the external storage medium and writes the pattern data of the designated pattern group to the second internal memory when a power switch is switched on.

9. The sewing apparatus according to claim 7, further comprising a writing selector, wherein the second internal memory comprises a writable volatile memory and a writable involatile memory and the writing selector selects to which of the volatile memory and the involatile memory the pattern data of the designated pattern group is written.

10. The sewing apparatus according to claim 7, further comprising:

a remaining memory determiner that determines the amount of the second internal memory that is available; and a sufficient memory determiner that compares the available second internal memory with the pattern data of the designated pattern group and determines whether the available second internal memory is sufficient to store the pattern data of the designated pattern group.

11. The sewing apparatus according to claim 10, wherein the input device writes the pattern data of the designated pattern group to the second internal memory only when the available second internal memory is sufficient to store the pattern data of the designated pattern group.

12. A sewing apparatus, comprising:

an external pattern data receiver supplied with data from an external storage medium storing pattern data of embroidery patterns;

an internal memory;

a sewing mechanism for sewing the embroidery patterns based on the pattern data; and an input device that reads predetermined data of the pattern data stored to the external storage medium and writes the predetermined data of the pattern data to the internal memory when a power source is switched on.

13. The sewing apparatus according to claim 12, wherein the input device reads the predetermined data of the pattern data stored to the external storage medium and writes the predetermined data of the pattern data to the internal memory essentially simultaneously with the switching on of the power source.

14. The sewing apparatus according to claim 12, wherein the input device reads the predetermined data of the pattern data stored to the external storage medium and writes the predetermined data of the pattern data to the internal memory essentially simultaneously with the external storage medium being connected to the external pattern data receiver.

15. The sewing apparatus according to claim 12, further comprising a displaying unit having a display and capable of displaying patterns.

16. A method of storing second pattern data of a plurality of embroidery patterns to a second internal memory of a sewing apparatus, the method comprising:

receiving the second pattern data from an external storage medium, the second pattern data being different from first pattern data of a plurality of embroidery patterns stored in a first internal memory; and reading all of the second pattern data from the external storage medium and writing the second pattern data to the second internal memory when a power source is switched on.

17. The method of claim 16, further comprising:

displaying, on a display, marks indicating pattern groups stored to the second internal memory such that the display marks can be identified from displayed group display marks indicating pattern groups stored to the first internal memory.

18. The method of claim 16, wherein the second internal memory comprises a writable volatile memory.

19. The method of claim 16, wherein the second internal memory comprises a writable involatile memory.

20. The method of claim 16, further comprising selecting to which of a volatile memory portion of the second internal memory and an involatile memory portion of the second internal memory the second pattern data is written.

21. The method of claim 16, further comprising selecting an embroidery pattern for sewing from the plurality of embroidery patterns stored to the second internal memory.

22. A method of storing second pattern data of a plurality of embroidery patterns to a second internal memory of a sewing apparatus, the method comprising:

receiving the second pattern data from an external storage medium, the second pattern data being different from first pattern data of a plurality of embroidery patterns stored in a first internal memory different from the second internal memory; and reading pattern data of a designated pattern group from the second pattern data from the external storage medium and writing the pattern data of the designated pattern group to the second internal memory.

23. The method of claim 22, wherein the pattern data of the designated pattern group is read from the external storage medium and written to the second internal memory when a power switch is switched on.

24. The sewing apparatus according to claim 12, wherein the predetermined data of the pattern data is all of the pattern data.

25. The sewing apparatus according to claim 13, wherein the predetermined data of the pattern data is all of the pattern data.

26. The sewing apparatus according to claim 14, wherein the predetermined data of the pattern data is all of the pattern data.

* * * * *